US005417024A

United States Patent [19]

San Paolo

[11] Patent Number: 5,417,024

[45] Date of Patent: May 23, 1995

[54] FIRE RESISTANT PANEL DOOR

[75] Inventor: David A. San Paolo, Springfield, Mo.

[73] Assignee: The Maiman Company, Springfield, Mo.

[21] Appl. No.: 134,972

[22] Filed: Oct. 23, 1993

[51] Int. Cl.[6] ..... E06B 3/70

[52] U.S. Cl. ..... 52/456; 52/455

[58] Field of Search ..... 52/455, 456, 457, 458

[56] References Cited

U.S. PATENT DOCUMENTS 3,512,304 5/1970 Meuret ..... 52/456 X
4,265,068 5/1981 Pomroy ..... 52/456
4,441,296 4/1989 Grabendike et al. ..... 52/456
4,870,797 10/1989 Hagemeyer ..... 52/455
5,218,807 6/1993 Fulford ..... 52/455

*Primary Examiner*—Carl D. Friedman
*Assistant Examiner*—Creighton Smith
*Attorney, Agent, or Firm*—Shook, Hardy & Bacon

[57] ABSTRACT

A fire resistant panel door is constructed from panels, stiles, mullion and rails having a core of fire resistant material. The door components are joined together so that the fire resistant material extends substantially continuously from side to side and from top to bottom of the finished door. The fire resistant core of each door panel is recessed within the fire resistant core of the associated rails and stiles to reduce air infiltration through the door which can compromise the door's fire resistance.

14 Claims, 1 Drawing Sheet

FIRE RESISTANT PANEL DOOR

BACKGROUND OF THE INVENTION

This invention relates in general to fire resistant structures and, more particularly, to a fire resistant door.

Fire barriers are included within the design of many types of buildings in order to block the spread of a fire once it has been ignited within the building. Because the placement of door openings in the walls of the building provides an avenue for the fire to spread from room to room, much attention has been focused on the designing of doors which are fire resistant and can impede the spread of the fire.

Panel doors have a plurality of flat or raised panels interconnected with vertically extending stiles and horizontal rails. Although panel doors are widely utilized because of their visually pleasing appearance, they generally have poor resistance to fire because air is able to infiltrate the door at the juncture of the panels with the stiles and rails. The fire is fed by the oxygen present in the air which seeps through the panel joints and can quickly burn through the door at those joints. In an effort to increase their fire resistance, some panel doors are available which have segments of fire resistant material inserted within grooves milled into the edges of the stiles, rails and panels at the junctures of those components. The placement of the fire resistant material at those locations is generally effective to slow the rate at which the fire can burn through the panel joints, but the fire is still able to burn through the wooden portions of the door at a faster rate than is desired in many instances.

Another type of conventional fire resistant door mimics the appearance of a panel door by applying half panels to a core of fire resistant material. The core comprises a solid sheet of material which is milled on both faces to form recesses at the intended location of the panels. Half panels are then positioned within the recesses and veneer and trim are applied to the exposed surfaces of the core. The resulting door can be very resistant to fire because the solid core blocks any air infiltration through the door. The milling operation, however, may reduce the structural integrity of the door and result in warping, sagging or other deformation of the door.

A need thus exists for a panel door which has an enhanced fire resistance but maintains the desired structural and visual appearance.

SUMMARY OF THE INVENTION

It is an object of this invention to provide a door of panelized construction which includes a fire resistant core which extends the full width and height of the door so that a substantially continuous fire barrier is formed to slow the rate at which a fire is able to burn through the door.

It is another object of this invention to provide a door having a high resistance to fire burning through the door but which is formed from component pieces which are assembled to form a panel construction so that the desired visual appearance is achieved.

To accomplish these and other related objects, in one aspect the invention is directed to a fire resistant panel door comprising a pair of spaced apart and parallel stiles and a pair of spaced apart and parallel rails which are interconnected with the stiles to frame an opening, a panel positioned within the opening and received within the stiles and rails, and a substantially continuous inner core of fire resistant material extending from one of said stiles through the panel and into the other stile, said inner core also extending from one of said rails through the panel and into the other rail.

In another aspect, the invention is directed to a method for constructing a fire resistant door, said method comprising the steps of providing a plurality of stiles and rails each having a center core formed of a fire resistant material and a groove formed along one edge, providing at least one panel having a center core formed of the fire resistant material, and assembling said door from the stiles, rails and panel by inserting the panel within the grooves formed in the stiles and rails, wherein the center cores of said stiles and rails interconnect with the center core of said panel to form a substantially continuous fire barrier.

BRIEF DESCRIPTION OF THE DRAWINGS

In the accompanying drawings which form a part of the specification and are to be read in conjunction therewith and in which like reference numerals are used to indicate like parts in the various views.

DESCRIPTION OF THE PREFERRED EMBODIMENT(S)

Figures 1, 2, 3, 4, 5:
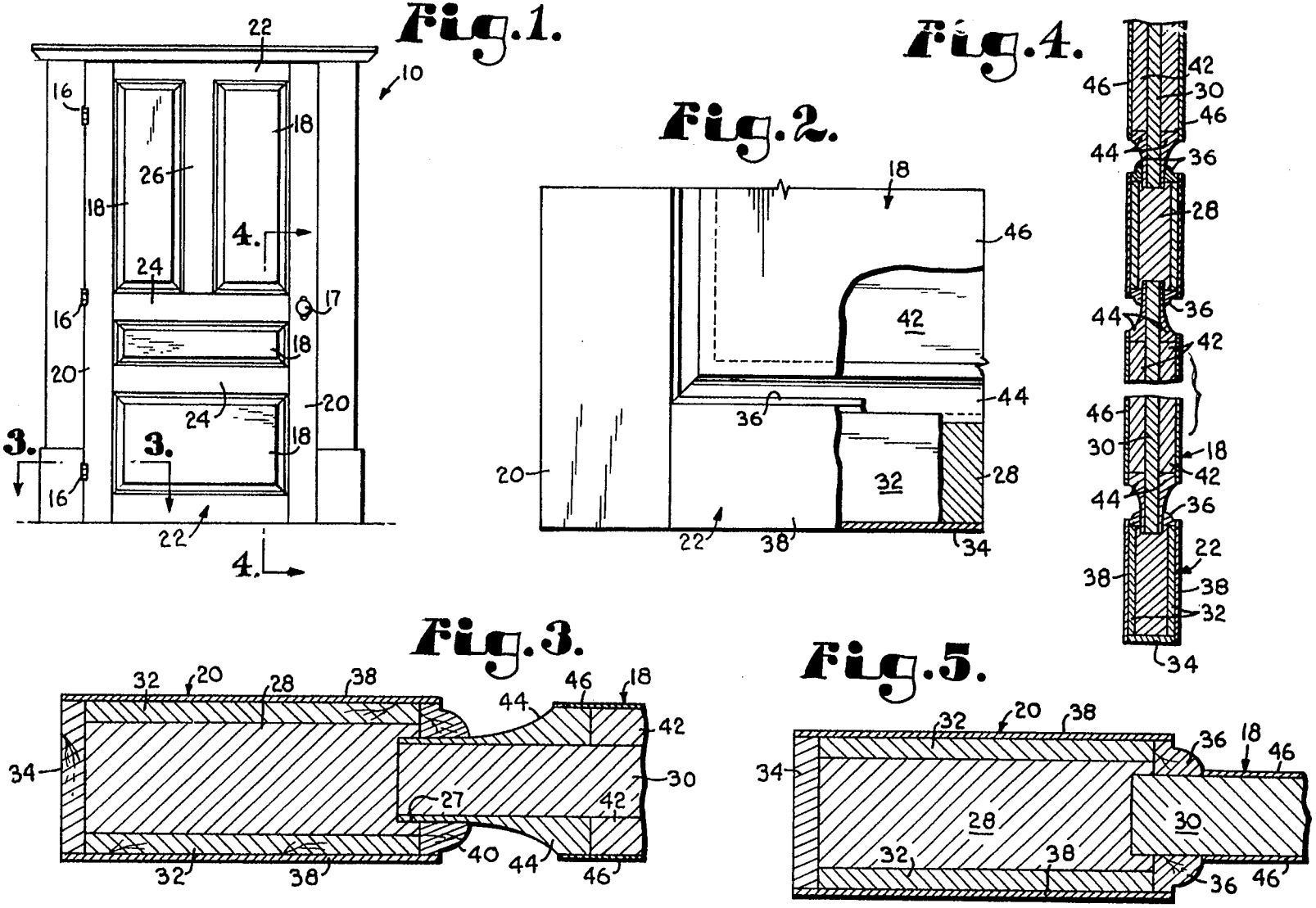
FIG. 1 is a front elevation view of a door assembly in accordance with the present invention.
FIG. 2 is an enlarged, fragmentary front elevation view of a lower corner of the door shown in FIG. 1 with portions broken away for purposes of illustration.
FIG. 3 is an enlarged, fragmentary top plan view of a lower corner of the door taken in horizontal section along line 3—3 of FIG. 1 in the direction of the arrows and showing the joinder of a raised panel within a stile.
FIG. 4 is a fragmentary side elevation view of the door taken in vertical section along line 4—4 of FIG. 1 in the direction of the arrows.
FIG. 5 is a fragmentary top plan view of a lower corner of a door similar to that shown in FIG. 3 but having a flat panel rather than a raised panel.

Turning now to the drawings in greater detail, and initially to FIG. 1, a door assembly in accordance with the present invention is represented generally by the numeral 10 and includes a door 12 mounted within a frame 14. Suitable hinges 16 are used to mount the door 12 to a hinge jamb (not shown) in a manner which allows the door to be opened and closed. A handle is provided on the door 12 to operate a latch (not shown) which retains the door in the closed position.

Door 12 is of a panelized construction of a type commonly referred to as a four panel door because of the presence of four separate panels 18 within the door. It will, of course, be appreciated that the invention encompasses doors having more or fewer panels. The door 12 includes side stiles 20 Which extend vertically along the sides of the door and top and bottom rails 22 which extend horizontally at the top and bottom of the door and are joined to the stiles 20. Intermediate rails 24 are also provided and extend between the side stiles 20 at intermediate locations. A center mullion 26 extends between one of the intermediate rails 24 and the top rail 22.

The stiles 20, mullion 26, and rails 22 and 24 are milled using suitable techniques so that they can be assembled together to form a frame in which the panels 18 are positioned. In a typical process, a groove 27 is milled along the side(s) of the stiles, mullion and rails to receive the panel and a tongue or cope (not shown) is cut into the ends of the rails 22 and 24 to allow them to be joined to the stiles 20. The ends of the mullion 26 are likewise milled to allow the mullion 26 to be joined to the top rail 22 and intermediate rail 24.

The panels 18 can be either of raised or flat construction. As best shown in FIG. 3, when panels 18 are raised, the edges of the panels must be milled so that they fit snugly within the grooves 27 cut into the sides of the stiles and rails. When flat panels 18 are used, as shown in FIG. 5, the entire panel 18 is of substantially the same thickness and is sized so that the edges of the panel fit snugly within the grooves 27.

In accordance with the present invention, each stile 20, mullion 26, and rail 22 and 24 includes an inner core 28 constructed of a fire resistant material. The material used for inner core 28 should have the properties necessary to achieve the fire resistance desired for the assembled door 12 and should also be capable of withstanding application of pressure such as from a fire hose after exposure to a fire. Desirably, the inner core 28 material should exhibit high screw holding strength and should be resistant to splitting and warping. An example of a preferred fire resistant material is a fiber and gypsum product available from Georgia-Pacific Corporation under the trademark Firestop.

Each panel 18 likewise has a core 30 constructed of the same fire resistant material used in the stiles 20, mullion 26, and rails 22 and 24. The fire resistant cores 28 and 30 extend substantially the full width and length of the associated stiles, mullions, rails, and panels so that a continuous fire barrier is formed across the width and length of the assembled door 12. Desirably, the inner core 30 of each panel 18 extends within, rather than simply abuts, the inner core 28 of the adjacent stiles, mullion and rails to reduce the opportunity for air infiltration.

The inner core 28 can be formed in the stiles 20, mullion 26, and rails 22 and 24 using various suitable methods. As illustrated, the stiles, mullion and rails are constructed by gluing or otherwise securing an optional spacer 32 to both faces of the stile, mullion or rail. A resorcinol resin glue which is thermoforming is preferably used to secure the spacers 32 to the core 28. The spacers 32 are utilized to provide the desired thickness to the stile or rail and can be constructed from particle board or other suitable material. Edge banding 34 and 36 formed from the desired wood is glued to the sides of core 28 and spacers 32. A wood veneer 38 is then applied to the outer faces of spacers 32, again preferably by gluing. If the spacers 32 are not utilized, the wood veneer is applied directly to the faces of the inner core 28.

Once the laminated stiles 20, mullion 26, and rails 22 and 24 have been glued, the groove 27 is milled into the edge(s) which will receive the associated panel 18. The groove 27 extends completely through the edge banding 36 and into the inner core 28. Prior to or in conjunction with milling of groove 27, a bead 40 is routed along the sides of edge band 36. It will be appreciated that the stiles and rails can be constructed in other suitable ways which will permit the inner core 28 to extend the length and width of the stiles and rails.

The panels 18 can also be constructed in a laminated fashion using spacers 42 glued to the faces of the core 30 except along the marginal edges where suitable wood trim 44 is applied. Wood veneer 46 is then applied to the outer faces of the spacers 42 and wood trim 44. The edges of the panels 18 can then be routed to provide the desired profile and to size the edges so that they fit snugly into the grooves 27 in the surrounding stiles, mullion and rails. When flat panels 18 are utilized as illustrated in FIG. 5, the spacers 42 and trim 44 are omitted and the veneer 46 is applied directly to the core 30.

The edges of the panels 18 extend into the grooves 27 in the adjacent stiles, mullion and rails and are secured in place using resorcinol resin glue to prevent the panels from floating in the grooves 27. The opportunity for air infiltration is further reduced by ensuring that the edges of the panels 18 extend completely to the bottom of the grooves 27. The edge of the panel core 30 thus contacts the stile, mullion or rail core 28 to provide a substantially continuous fire barrier which extends from the stiles and rails through the panels and then through the stiles and rails or mullion on the opposite side of the panels. The use of the thermoforming resorcinol resin glue to secure the laminates also prevents the adhesive from melting at critical areas where a fire might burn through the door 12. Adhesives such thermoplastic polyvinyl acetates can be used at non-critical areas where appearance is important.

It will be appreciated that the described construction allows all exterior surfaces of the door 12 to be formed of the desired wood, such as fir, walnut and the like, with the grain orientation in the wood providing a visually pleasing appearance. The interior of the door 12, however, has a substantially continuous fire barrier formed by the interconnected inner cores 28 and 30 of the respective stiles 20, mullion 26, rails 22 and 24, and panels 18.

Notably, fire doors constructed in accordance with the present invention have achieved a fire rating of 60 minutes resistance to fire burn-through when subjected to standardized testing. This remarkable performance makes the door 12 particularly well-suited for use as a fire door while still having the pleasing appearance of a panel door.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A fire resistant panel door comprising:

a pair of spaced apart and parallel stiles;

a pair of spaced apart and parallel rails extending between and joined to the stiles to frame an opening, each of said stiles and rails being formed as a separate component piece comprising a front face and a back face and an inner core of fire resistant material positioned between the front and back faces, said stiles and rails then being joined together to frame said opening; and a panel positioned within the opening and received within the stiles and rails, said panel having a front face and a back face and an inner gore of fire resistant material positioned between the front and back faces, said inner cores of the stiles, rails and panel being separate components which are interconnected to present a substantially continuous fire barrier extending from one of said stiles through the panel and into the other stile and from one of said rails through the panel and into the other rail when said stiles and rails are joined together and said panel is received with the stiles and rails.

2. The fire resistant panel door as set forth in claim 1, wherein said stiles, rails and panel are of a laminated construction and include a wood veneer applied to faces of said stiles, rails and panel.

3. The fire resistant panel door as set forth in claim 2, wherein said panel is of a thickness which is approximately the same as that of the stiles and rails.

4. The fire resistant panel door as set forth in claim 2, wherein said panel is of a thickness less than that of the stiles and rails.

5. The fire resistant panel door as set forth in claim 2, including a pair of additional openings framed at least in part by the stiles, a mullion and an additional rail and a pair of panels positioned within said pair of additional openings, said substantially continuous inner core of fire resistant material extending through said pair of panels and into the stiles, mullion and additional rail.

6. The fire resistant panel door as set forth in claim 2, including a plurality of additional openings framed at least in part by the stiles and an additional rail with additional panels positioned within said additional openings, said substantially continuous inner core of fire resistant material extending through said additional panels and into the stiles and the additional rail.

7. A fire resistant panel door comprising:

a panel having front and back faces and an inner core positioned between the front and back faces, said panel having a periphery defined by vertical side edge portions, a top edge portion and a bottom edge portion;

a pair of spaced apart stiles extending along the vertical side portions of the panel, each of said stiles having exposed front and back faces and an inner core positioned between the front and back faces; and a pair of spaced apart rails extending along the top and bottom edge portions of the panel, each of said rails having exposed front and back faces, an inner core positioned between the front and back faces and opposed ends which are joined to the stiles, said stiles and rails being formed as separate component pieces and then being joined together with the vertical side portions of the panel extending within the stiles and the top and bottom edge portions of the panel extending within the rails, said inner cores of the panel, stiles and rails comprising a fire resistant material and being separate components which are interconnected to form a substantially continuous fire barrier.

8. The fire resistant panel door as set forth in claim 7, wherein said stiles, rails and panel are of a laminated construction and include a wood veneer applied to faces of said stiles, rails and panel.

9. The fire resistant panel door as set forth in claim 8, wherein said panel is of a thickness which is approximately the same as that of the stiles and rails.

10. The fire resistant panel door as set forth in claim 8, wherein said panel is of a thickness less than that of the stiles and rails.

11. A fire resistant panel door comprising:

a pair of spaced apart and parallel stiles, each of said stiles having an inner core of fire resistant material;

a mullion positioned between and extending parallel to the stiles and having an inner core of fire resistant material;

pairs of spaced apart and parallel rails, each of said rails having an inner core of fire resistant material, the stiles, mullion and rails being formed as separate component pieces and then being interconnected to frame a plurality of openings; and panels positioned within the openings and received within the stiles, mullion and rails, said panels having an inner core of fire resistant material said inner cores of the stiles, mullion, rails and panel being separate components which are interconnected to present a substantially continuous fire barrier extending from the stile on one side of each panel, through the panel and into the stile or mullion on an opposite side of each panel, and from the rail above each panel, through the panel and into the rail on an opposite side of each panel when said stiles, mullion and rails are joined together and said panel is received with the stiles and rails.

12. The fire resistant panel door as set forth in claim 12, wherein said stiles, mullion, rails and panels are of a laminated construction and include a wood veneer applied to faces of said stiles, mullion, rails and panel.

13. The fire resistant panel door as set forth in claim 12, wherein said panels are of a thickness which is approximately the same as that of the stiles, mullion and rails.

14. The fire resistant panel door as set forth in claim 12, wherein said panels are of a thickness less than that of the stiles, mullion and rails.

* * * * *

US005417024C1

(12) REEXAMINATION CERTIFICATE (4673rd)

United States Patent

San Paolo

(10) Number: US 5,417,024 C1

(45) Certificate Issued: Nov. 26, 2002

(54) FIRE RESISTANT PANEL DOOR

(75) Inventor: David A. San Paolo, Springfield, MO (US)

(73) Assignee: The Maiman Company, Springfield, MO (US)

Reexamination Request:
No. 90/005,535, Oct. 19, 1999
No. 90/005,540, Oct. 26, 1999

Reexamination Certificate for:

| | |
|---|---|
| Patent No.: | **5,417,024** |
| Issued: | **May 23, 1995** |
| Appl. No.: | **08/134,972** |
| Filed: | **Oct. 23, 1993 08/134,972** |

(51) Int. Cl.[7] ..... E06B 3/70

(52) U.S. Cl. ..... 52/456; 52/455

(58) Field of Search ..... 52/455, 456, 457, 52/458

(56) References Cited

U.S. PATENT DOCUMENTS

| | | | | |
|---|---|---|---|---|
| 826,549 A | * | 7/1906 | Diver | 52/455 X |
| 3,512,304 A | | 5/1970 | Meuret | |
| 4,159,302 A | | 6/1979 | Greve et al. | |
| 4,265,068 A | * | 5/1981 | Pomroy | 52/456 |
| 4,343,127 A | | 8/1982 | Greve et al. | |
| 4,367,614 A | | 1/1983 | Warwick | |
| 4,441,296 A | * | 4/1984 | Grabendike et al. | 52/465 |
| 4,702,054 A | | 10/1987 | Turner | |
| 4,748,771 A | | 6/1988 | Lehnert et al. | |
| 4,896,471 A | | 1/1990 | Turner | |

FOREIGN PATENT DOCUMENTS

GB 2 060 746 A 5/1981

OTHER PUBLICATIONS

Georgia–Pacific, Fire Door Products, pp. 1–9.

"Architectural Woodwork Quality Standards, Guide Specifications and Quality Certification Program", 1984, pp. 107–108.

Karona, Inc., Manufacturing Specifications, 20–Minute Panel Door, "1¾" Cross Section", 1991.*

Karona, Inc., Manufacturing Specifications, 20–Minute Panel Door, "1¾" Fire Cope", 1991.*

* cited by examiner

*Primary Examiner*—Laura A. Callo

(57) ABSTRACT

A fire resistant panel door is constructed from panels, stiles, mullion and rails having a core of fire resistant material. The door components are joined together so that the fire resistant material extends substantially continuously from side to side and from top to bottom of the finished door. The fire resistant core of each door panel is recessed within the fire resistant core of the associated rails and stiles to reduce air infiltration through the door which can compromise the door's fire resistance.

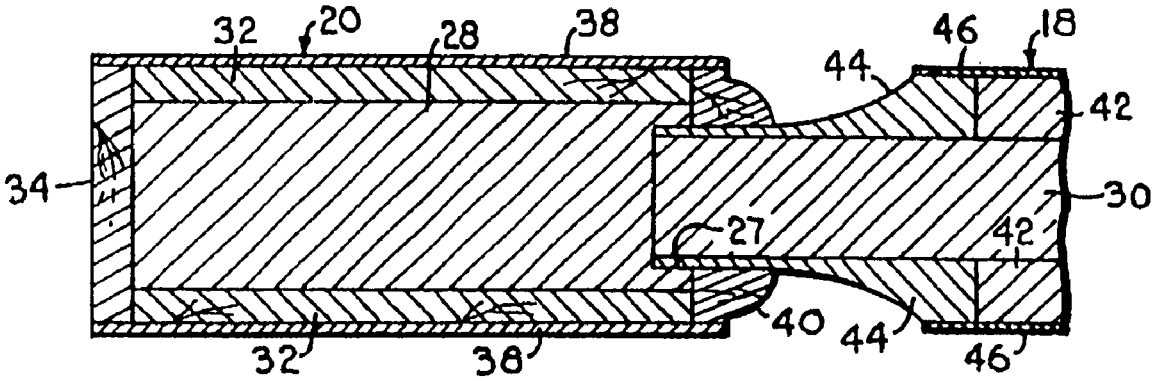

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–14 are cancelled.

* * * * *